US007311371B2

(12) United States Patent
Kitawaki et al.

(10) Patent No.: US 7,311,371 B2
(45) Date of Patent: Dec. 25, 2007

(54) METHOD FOR INKJET RECORDING

(75) Inventors: Takaya Kitawaki, Izunokuni (JP); Masashi Hiroki, Yokohama (JP); Hiroshi Kiyomoto, Hiratsuka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 43 days.

(21) Appl. No.: 11/412,081

(22) Filed: Apr. 26, 2006

(65) Prior Publication Data

US 2007/0252859 A1 Nov. 1, 2007

(51) Int. Cl.
*B41J 29/38* (2006.01)

(52) U.S. Cl. ..... 347/14; 347/16; 106/31.13

(58) Field of Classification Search ..... 347/14, 347/16, 43, 96, 95, 100, 105, 101; 106/31.13
See application file for complete search history.

(56) References Cited

U.S. PATENT DOCUMENTS

| | | | | |
|---|---|---|---|---|
| 4,820,346 | A * | 4/1989 | Nowak | 564/169 |
| 2002/0051047 | A1* | 5/2002 | Asaoka et al. | 347/106 |
| 2004/0227799 | A1* | 11/2004 | Ogawa et al. | 347/100 |
| 2005/0215664 | A1* | 9/2005 | Elwakil et al. | 523/160 |

FOREIGN PATENT DOCUMENTS

| | | | |
|---|---|---|---|
| JP | 2003-20424 | A | 1/2003 |
| JP | 2004-174948 | A | 6/2004 |
| JP | 2005-193660 | A | 7/2005 |

* cited by examiner

*Primary Examiner*—Lamson Nguyen
(74) *Attorney, Agent, or Firm*—Frishauf, Holtz, Goodman & Chick, P.C.

(57) ABSTRACT

A method for recording on a recording medium by discharging a non-aqueous ink containing a non-aqueous solvent and a pigment by an inkjet system. The method contains a step of preparing recording paper having a thickness exceeding 0.083 mm as a recording medium, a step of obtaining a volume $V_m$ and a thickness $T_m$ of the recording paper, a step of obtaining a volume $V_s$ of a solvent that is capable of being retained by the recording paper by using a solvent having a vapor pressure at 25° C. of 0.001 mmHg or less and a specific gravity of from 0.800 to 1.200, a step of obtaining a solvent absorptivity $A_{sl.}$ (%) of the recording paper by the following equation (1):

$$A_{sl.}=(V_s/V_m)\times 100 \quad (1)$$

a step of obtaining an allowable ink amount $V_I$ (pl/m$^2$) per unit area of the recording paper by the following equation (2):

$$V_I=(T_m-0.083)\times A_{sl.}\times 10^{12} \quad (2)$$

and a step of discharging the non-aqueous ink in an amount $V_d$ (pl/m$^2$) satisfying the following equation (3) by an inkjet system:

$$V_d \leqq V_I. \quad (3)$$

12 Claims, 4 Drawing Sheets

METHOD FOR INKJET RECORDING

BACKGROUND OF THE INVENTION

1. Field of the Invention

The present invention relates to a method for inkjet recording, and in particular to a method for inkjet recording using a non-aqueous ink.

2. Description of the Related Art

In recent years, a recording apparatus using an inkjet recording system is widely used in household use as well as office use and industrial use. Various inks, such as aqueous, non-aqueous and UV, are used in the recording apparatus of an inkjet recording system. Among these, an aqueous ink is used in a wide range of purposes owing to the low cost and safety thereof, but has such a defect that the ink is slowly dried upon applied to high-speed printing. Furthermore, in the case where an aqueous ink is printed on ordinary paper (PPC paper) as a recording medium, the paper is waved after printing, i.e., so-called cockling occurs. A UV ink is rapidly cured upon irradiation of an ultraviolet ray, and is suitable for applying to printing to a non-absorptive medium and high-speed printing. However, a recording apparatus for a UV ink requires an ultraviolet ray irradiation device, which is large sized and consumes a large amount of electric power.

Upon printing a non-aqueous ink on ordinary paper, on the other hand, an ink droplet discharged from an inkjet head and reaching the recording paper penetrates into the interior of the recording paper in a short period of time. As a result, high-speed printing can be performed without any special mechanism, and a favorable recorded image can be obtained without cockling.

BRIEF SUMMARY OF THE INVENTION

In offices and homes, both faces of paper are printed for saving paper resources in most cases. In order to perform double face printing on ordinary paper by an inkjet system, it is demanded to attain a high printing density and a low print through density. In the case where a non-aqueous ink that is substantially not evaporated at ordinary temperature is used for printing, the print through density is increased when a large amount of the ink is discharged to increase the printing density, which is not suitable for double face printing.

An object of the invention is to provide such a method for non-aqueous inkjet recording that exhibits a low print through density and is suitable for double face printing.

According to one embodiment, the invention relates to a method for inkjet recording by discharging a non-aqueous ink containing a non-aqueous solvent and a pigment by an inkjet system to record on a recording medium, the method containing:

a step of preparing recording paper having a thickness exceeding 0.083 mm as a recording medium, a step of obtaining a volume $V_m$ and a thickness $T_m$ of the recording paper, a step of obtaining a volume $V_s$ of a solvent that is capable of being retained by the recording paper by using a solvent having a vapor pressure at 25° C. of 0.001 mmHg or less and a specific gravity of from 0.800 to 1.200, a step of obtaining a solvent absorptivity $A_{sl.}$ (%) of the recording paper by the following equation (1):

$$A_{sl.}=(V_s/V_m)\times 100 \quad (1)$$

a step of obtaining an allowable ink amount $V_I$ (pl/m$^2$) per unit area of the recording paper by the following equation (2):

$$V_I=(T_m-0.083)\times A_{sl.}\times 10^{12} \quad (2)$$

and a step of discharging the non-aqueous ink in an amount $V_d$ (pl/m$^2$) satisfying the following equation (3) by an inkjet system:

$$V_d \leqq V_I \quad (3)$$

According to another embodiment, the invention relates to a method for selecting recording paper, on which double face printing is performed by discharging a non-aqueous ink in an amount $V_d$ (pl/m$^2$), the method containing:

a step of preparing recording paper having a thickness exceeding 0.083 mm, a step of obtaining a volume $V_m$ and a thickness $T_m$ of the recording paper, a step of obtaining a volume $V_s$ of a solvent that is capable of being retained by the recording paper by using a solvent having a vapor pressure at 25° C. of 0.001 mmHg or less and a specific gravity of from 0.800 to 1.200, a step of obtaining a solvent absorptivity $A_{sl.}$ (%) of the recording paper by the following equation (1):

$$A_{sl.}=(V_s/V_m)\times 100 \quad (1)$$

a step of obtaining an allowable ink amount $V_I$ (pl/m$^2$) per unit area of the recording paper by the following equation (2):

$$V_I=(T_m-0.083)\times A_{sl.}\times 10^{12} \quad (2)$$

and a step of selecting the recording paper that satisfies a condition of the following equation (3):

$$V_d \leqq V_I \quad (3)$$

According to still another embodiment, the invention relates to a method for evaluating an ink discharge amount for performing double face printing by discharging a non-aqueous ink to recording paper, the method containing:

a step of preparing recording paper having a thickness exceeding 0.083 mm, a step of obtaining a volume $V_m$ and a thickness $T_m$ of the recording paper, a step of obtaining a volume $V_s$ of a solvent that is capable of being retained by the recording paper by using a solvent having a vapor pressure at 25° C. of 0.001 mmHg or less and a specific gravity of from 0.800 to 1.200, a step of obtaining a solvent absorptivity $A_{sl.}$ (%) of the recording paper by the following equation (1):

$$A_{sl.}=(V_s/V_m)\times 100 \quad (1)$$

a step of obtaining an allowable ink amount $V_I$ (pl/m$^2$) per unit area of the recording paper by the following equation (2):

$$V_I=(T_m-0.083)\times A_{sl.}\times 10^{12} \quad (2)$$

and a step of selecting an amount $V_d$ (pl/m$^2$) satisfying the following equation (3) as an ink amount discharged to the recording paper:

$$V_d \leqq V_I \quad (3)$$

Additional objects and advantages of the invention are given in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
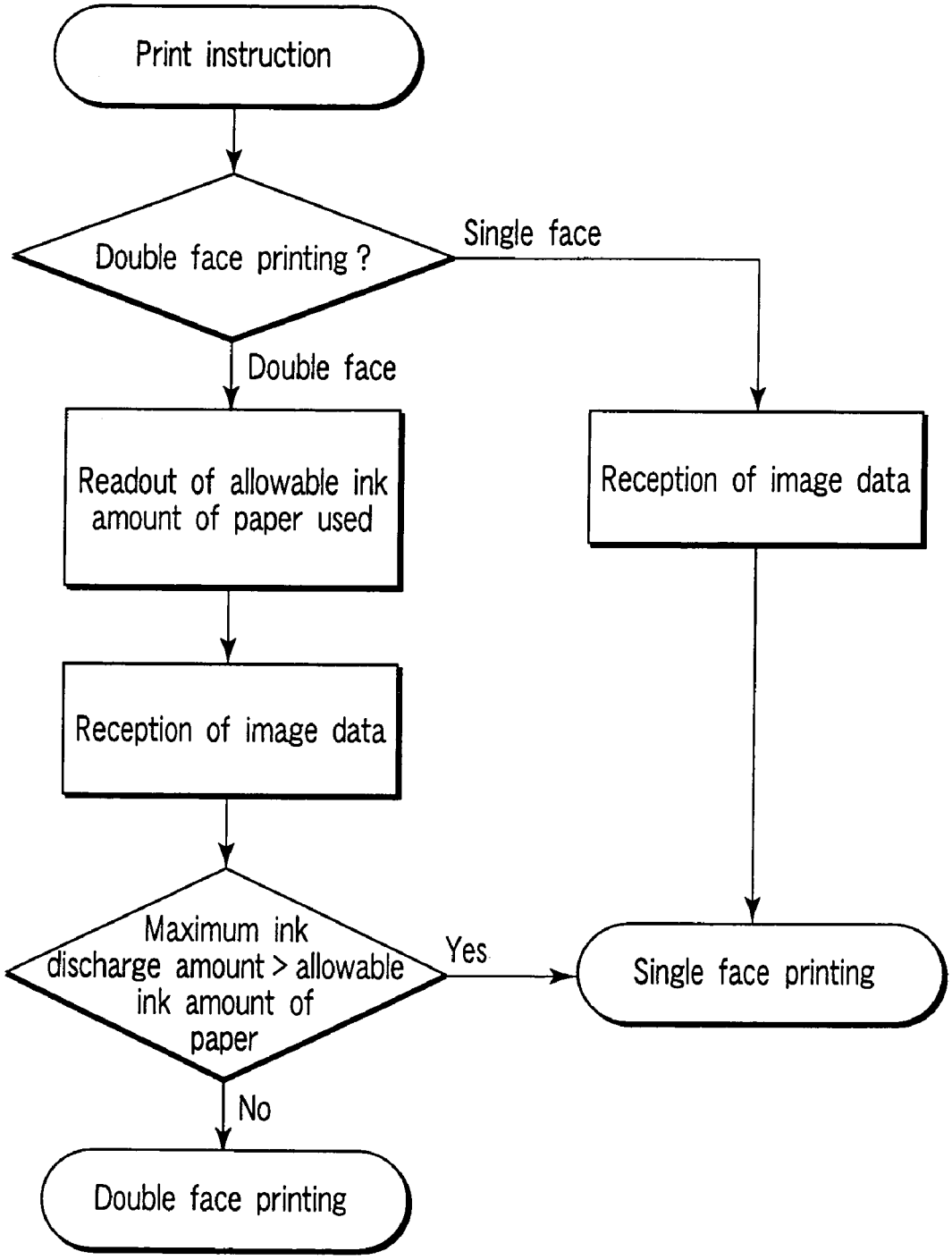
FIG. 1 is a block diagram showing process steps of a recording method according to one embodiment of the invention.

Embodiments of the invention will be described below.

In the recording method according to an embodiment of the invention, a non-aqueous ink is used. The non-aqueous ink is an ink obtained by dispersing a pigment in a non-aqueous solvent by using a dispersant. The components contained therein will be described.

The non-aqueous solvent is a high boiling point solvent that is substantially not evaporated at ordinary temperature (25° C.) and designates general solvents other than water.

As the solvent, a high boiling point solvent that is substantially not evaporated at ordinary temperature is used among an ester solvent, an alcohol solvent, a higher fatty acid solvent, a vegetable oil, an ether solvent, an aliphatic hydrocarbon solvent, an aromatic hydrocarbon solvent and the like.

Specifically, examples of the ester solvent include 2-ethylhexyl isononanoate, isononyl isononanoate, isodecy isononanoate, isotridecyl isononanoate, methyl laurate, ethyl laurate, isopropyl laurate, methyl mylistate, ethyl mylistate, isopropyl mylistate, methyl palmitate, ethyl palmitate, isopropyl palmitate, methyl oleate, ethyl oleate, isopropyl oleate, methyl linoleate, ethyl linoleate, isopropyl linoleate, methyl isostearate, ethyl isostearate, isopropyl isostearate, methyl soybean oil, ethyl soybean oil, isopropyl soybean oil, di-2-ethylhexyl succinate, diethyl adipate, diisopropyl adipate, diethyl sebacate, diisopropyl sebacate, isocetyl 2-ethylhexanoate, cetyl 2-ethylhexanoate, octyl palmitate, octyldodecyl pivalate, isocetyl mylistate, octyldodecyl dimethyloctanoate, glycerin tri(caprylate-caprate), 2-hexyldecyl isostearate, isocetyl stearate, trimethylolpropane tri-2-ethylhexanoate and isostearyl isostearate.

Examples of the alcohol solvent include isomylistyl alcohol, isopalmityl alcohol, isostearyl alcohol and oleyl alcohol.

Examples of the higher fatty acid solvent include isononanoic acid, isomylistic acid, isopalmitic acid, oleic acid, linolenic acid and isostearic acid.

Examples of the vegetable oil include soybean oil, rapeseed oil, corn oil, linseed oil, safflower oil and coconut oil.

Examples of the ether solvent include diethyl glycol monobutyl ether, ethylene glycol monobutyl ether, propylene glycol monobutyl ether and propylene glycol dibutyl ether.

Examples of the aliphatic hydrocarbon solvent include Tekleen N-16, Tekleen N-20, Tekleen N-22, Nisseki Naphtesol L, Nisseki Naphtesol M, Nisseki Naphthesol H, No. 0 Solvent L, No. 0 Solvent M, No. 0 Solvent H, Nisseki Isosol 300, Nisseki Isosol 400, AF-4, AF-5, AF-6 and AF-7, all produced by Nippon Oil Corp., Isopar G, Isopar H, Isopar L, Isopar M, Exxol D40, Exxol D80, Exxol D100, Exxol D130 and Exxol D140, all produced by Exxon Mobile Corp., and Moresco White P-55, P-60, P-70, P-80, P-85, P-100, P-120, P-150 and P-200, and Moresco Bioless U-6, U-7 and U-8, all produced by Matsumura Oil Research Corp.

Examples of the aromatic hydrocarbon solvent include Nisseki Leansol G, Nippon Oil Corp.

The non-aqueous solvents may be used solely or in combination of two or more kinds thereof.

A pigment is dispersed in the non-aqueous solvent by using a dispersant to prepare a non-aqueous ink used in the embodiment of the invention.

Examples of the pigment include a light absorptive pigment. Specific examples thereof include a carbon pigment, such as carbon black, carbon refined and carbon nanotube; a metallic oxide pigment, such as iron black, cobalt blue, zinc oxide, titanium oxide, chromium oxide and iron oxide; a sulfide pigment, such as zinc sulfide; a phthalocyanine pigment; a pigment containing a metallic salt, such as a sulfate salt, a carbonate salt, a silicate salt and a phosphate salt; and a pigment containing metallic powder, such as aluminum powder, bronze powder and zinc powder.

Furthermore, an organic pigment may also be used, examples of which include a dye chelate (such as a basic dye chelate and an acidic dye chelate), a nitro pigment, a nitroso pigment, such as aniline black and naphthol green B, an azo pigment (including an azo lake pigment, an insoluble azo pigment, a condensed azo pigment and a chelate azo pigment), such as Bordeaux 10B, Lake Red 4R and Chromophthal Red, a lake pigment, such as Peacock Blue Lake and Rhodamine Lake, a phthalocyanine pigment, such as Phthalocyanine Blue, a polycyclic pigment (such as a perylene pigment, a perynone pigment, an anthraquinone pigment, a quinacridone pigment, a dioxane pigment, a thioindigo pigment, an isoindoline pigment and a quinophthalone pigment), a threne pigment, such as Thioindigo Red and Indanthrone Blue, a quinacridone pigment, a quinacridine pigment, and an isoindoline pigment.

Examples of a pigment capable of being used in a black ink include Raven 5750, Raven 5250, Raven 5000, Raven 3500, Raven 1255 and Raven 700, all produced by Columbian Chemicals Company, Regal 400R, Regal 330R, Regal 660R, Mogul L, Monarch 700, Monarch 800, Monarch 880, Monarch 900, Monarch 1000, Monarch 1100, Monarch 1300 and Monarch 1400, all produced by Cabot Oil & Gas Corp., and No. 2300, No. 900, MCF88, No. 33, No. 40, No. 45, No. 52, MA7, MA8, MA100 and No. 2200B, all produced by Mitsubishi Chemical Corp., Color Black FW1, Color Black FW2, Color Black FW2V, Color Black FW18, Color Black FW200, Color Black S150, Color Black S160, Color Black S170, Printex 35, Printex 45, Printex U, Printex V, Printex 140U, Special Black 6, Special Black 5, Special Black 4A and Special Black 4, all produced by Degussa AG.

Examples of a pigment capable of being used in a yellow ink include C.I. Pigment Yellow 128, C.I. Pigment Yellow 129, C.I. Pigment Yellow 151, C.I. Pigment Yellow 154, C.I. Pigment Yellow 1, C.I. Pigment Yellow 2, C.I. Pigment Yellow 3, C.I. Pigment Yellow 12, C.I. Pigment Yellow 13, C.I. Pigment Yellow 14C, C.I. Pigment Yellow 16, C.I. Pigment Yellow 17, C.I. Pigment Yellow 73, C.I. Pigment Yellow 74, C.I. Pigment Yellow 75, C.I. Pigment Yellow 83, C.I. Pigment Yellow 93, C.I. Pigment Yellow 95, C.I. Pigment Yellow 97, C.I. Pigment Yellow 98 and C.I. Pigment Yellow 114.

Examples of a pigment capable of being used in a magenta ink include C.I. Pigment Red 122, C.I. Pigment Red 123, C.I. Pigment Red 168, C.I. Pigment Red 184, C.I. Pigment Red 202, C.I. Pigment Red 5, C.I. Pigment Red 7, C.I. Pigment Red 12, C.I. Pigment Red 48(Ca), C.I. Pigment Red 48(Mn), C.I. Pigment Red 57(Ca), C.I. Pigment Red 57:1 and C.I. Pigment Red 112.

Examples of a pigment capable of being used in a cyan ink include C.I. Pigment Blue 15:3, C.I. Pigment Blue 15:34, C.I. Pigment Blue 16, C.I. Pigment Blue 22, C.I. Pigment Blue 60, C.I. Pigment Blue 1, C.I. Pigment Blue 2, C.I. Pigment Blue 3, C.I. Vat Blue 4 and C.I. Vat Blue 60.

The pigment is generally dispersed in the non-aqueous solvent in an amount of about from 1 to 25% based on the total weight of the ink. All "%" in the specification are by weight unless otherwise indicated.

As the dispersant for dispersing the pigment in the solvent, a pigment dispersant having been ordinarily used in a non-aqueous solvent may be used. An arbitrary pigment dispersant may be used as far as it is compatible with the non-aqueous solvent and can disperse the pigment to fine particles.

Specific examples of the dispersant include a nonionic surfactant including a sorbitan fatty acid ester (such as sorbitan monooleate, sorbitan monolaurate, sorbitan sesquioleate and sorbitan oleate), a polyoxyethylene sorbitan fatty acid ester (such as polyoxyethylene sorbitan monostearate and polyoxyethylene sorbitan monooleate), a polyethylene glycol fatty acid ester (such as polyoxyethylene monostearate and polyoxyethylene glycol diisocyanate), a polyoxyethylene alkylphenyl ether (such as polyoxyethylene nonylphenyl ether and polyoxyethylene octylphenyl ether), and an aliphatic diethanolamide compound.

A polymer dispersant may also be used, and in this case, a polymer compound having a molecular weight of 1,000 or more is preferably used. Examples thereof include a styrene-maleic acid resin, a styrene-acrylate resin, rosin, BYK-122 and 116 (acrylic polymer compounds, produced by BYK Chemie Co., Ltd.), BYK-160, 162, 164 and 182 (urethane polymer compounds, produced by BYK Chemie Co., Ltd.), EFKA-47 and LP-4050 (urethane polymer dispersants, produced by EFKA Additives Co. Ltd.), EFKA-4300 (a polyacrylate polymer dispersant, produced by EFKA Additives Co. Ltd.), Solsperse 13940 (a polyesteramine polymer compound, produced by Nippon Luberesol Co., Ltd.), Solsperse 17000 and 18000 (aliphatic amine polymer compounds, produced by Nippon. Luberesol Co., Ltd.), and Solsperse 22000, 24000 and 28000 (polyester polymer compounds, produced by Nippon Luberesol Co., Ltd.)

The dispersant can exert the function thereof when it presents in an amount of about from 25 to 100% based on the weight of the pigment.

Upon preparing the non-aqueous ink used in the embodiment of the invention, the pigment and the dispersant are added to the non-aqueous solvent, which are then subjected to a dispersion treatment with a dispersing device, such as a beads mill. Subsequently, pigment aggregates and the like are removed with a filter or the like to obtain the desired non-aqueous ink.

The non-aqueous ink preferably has a viscosity at 25° C. of about 100 mPa·sec or less since it is used for recording by an inkjet system. An ink having a viscosity at 25° C. of about 100 mPa·sec or less can be favorably discharged to form an image without excessive heating of an inkjet head.

In the recording method of the embodiment of the invention, the non-aqueous ink is discharged to recording paper as a recording medium by an inkjet system to attain recording. In particular, paper of the plain paper type is used. The paper of the plain paper type designates such paper that has no distinct coated layer on the surface thereof with fibers of paper exposed thereon. Recording paper having a coated layer may also be used as far as fibers are not shielded to maintain texture equivalent to plain paper.

It is necessary that the recording paper used herein has a thickness exceeding 0.083 mm. In the case where the thickness is 0.083 mm or less, print through occurs with an unallowable density to fail to attain the objects of the invention. The thickness of the recording paper is preferably 0.095 mm or more, and more preferably 0.100 mm or more.

In the method of the embodiment of the invention, the non-aqueous ink is discharged in a suitable discharge amount corresponding to the recording paper to attain recording.

In order to obtain the suitable discharge amount corresponding to the recording paper, the physical property values of the recording paper are firstly measured. As the physical property values, the basis weight and the thickness are measured. The basis weight of the recording paper is measured according to JIS P8124-1998, and the thickness of the recording paper is measured according to JIS P8118-1998. The thickness referred herein is not a bulk thickness but is a thickness of a single sheet.

The volume $V_m$ of the recording paper is calculated based on the area of the recording paper and the thickness of the recording paper thus measured.

The solvent absorptivity of the recording paper is obtained by using a solvent having a vapor pressure at 25° C. of 0.001 mmHg or less and a specific gravity of from 0.800 to 1.200. The solvent having such vapor pressure and specific gravity is suitable for obtaining the solvent absorptivity of the recording paper since it is not evaporated at ordinary temperature. Examples of the solvent used include an ester solvent, such as ICM-R (isocetyl mylistate, produced by Kokyu Alcohol Kogyo Co., Ltd., specific gravity: 0.857), an ether solvent, such as Butycenol 40 (tetraethylene glycol monobutyl ether, produced by Kyowa Hakko Chemicals Co., Ltd., specific gravity: 1.008), and Isostearyl Alcohol EX (isostearyl alcohol, produced by Kokyu Alcohol Kogyo Co., Ltd., specific gravity: 0.843).

The solvent having the aforementioned requirements is housed in a container, into which the recording paper having a volume $V_m$ is immersed to impregnate the recording paper completely with the solvent. The recording paper impregnated completely with the solvent is taken out from the container and then allowed to stand, and the solvent oozing out is wiped in each case. The state where no solvent oozed out from the recording paper is referred to as a state where "the recording paper retains the solvent". At this time, the volume of the solvent capable of being retained by the recording paper is measured and expressed by $V_s$.

The solvent absorptivity $A_{sl.}$ (%) of the recording paper is calculated by using the volume $V_m$ of the recording paper and the volume $V_s$ of the solvent capable of being retained by the recording paper according to the following equation (1):

$$A_{sl.}=(V_s/V_m)\times 100 \quad (1)$$

The allowable ink amount $V_I$ (pl/m$^2$) per unit area of the recording paper is calculated by using the resulting solvent absorptivity $A_{sl.}$ (%) and the thickness $T_m$ of the recording paper according to the following equation (2):

$$V_I=(T_m-0.083)\times A_{sl.}\times 10^{12} \quad (2)$$

In the method of the embodiment of the invention, the ink discharge amount per unit area is determined based on the allowable ink amount $V_I$ (pl/m$^2$) per unit area of the recording paper thus calculated. Specifically, the non-aqueous ink is discharged from an inkjet head in an amount equal to or less than the allowable ink amount $V_I$ (pl/m$^2$) per unit area of the recording paper to attain recording. Accordingly, the amount $V_d$ (pl/m$^2$) of the non-aqueous ink discharged per unit area satisfies the following equation (3):

$$V_d \leqq V_I \quad (3)$$

The ink discharge amount for performing favorable double face printing on the recording paper is determined in this manner.

The non-aqueous ink is discharged in an amount equal to or less than the allowable ink amount per unit area of the recording paper, whereby recording suitable for double face printing can be performed with a low print through density by using the method of the embodiment of the invention.

In other words, in the case where the amount of the non-aqueous ink $V_d$ (pl/m$^2$) discharged to the recording paper has been known, favorable images can be obtained by double face printing by selecting recording paper having an allowable ink amount $V_I$ (pl/m$^2$) satisfying the requirement of the equation (3).

The requirement of the equation (3) is applied not only to recording by an inkjet recording system.

The invention will be described in more detail with reference to specific examples below. The invention is not construed as being limited to the examples unless it deviates from the technical concept of the invention.

Nine kinds of recording paper (A to I) different in basis weight and thickness were prepared, and all the kinds of recording paper were measured for basis weight and thickness. The basis weight was measured according to JIS P8124-1998, and the thickness was measured according to JIS P8118-1998. The volumes $V_m$ of all the kinds of recording paper were obtained by using the areas of the recording paper and the thickness of the recording paper thus measured, and then the volume $V_s$ of the solvent capable of being retained by the recording paper was obtained by using ICM-R as the solvent. The solvent absorptivity $A_{sl.}$ (%) of the recording paper was calculated by using these values according to the equation (1).

Furthermore, the allowable ink amounts $V_I$ (pl/m$^2$) per unit area of the recording paper were calculated according to the equation (2). The resulting allowable ink amounts are shown in Table 1 below along with the basis weight, the thickness and the solvent absorptivity.

TABLE 1

| | Basis weight (g/m$^2$) | Thickness of paper (mm) | Ink absorptivity | Allowable ink amount (pl/m$^2$) |
|---|---|---|---|---|
| A | 69.7 | 0.091 | 35.3% | $2.82 \times 10^9$ |
| B | 77.3 | 0.096 | 34.9% | $4.53 \times 10^9$ |
| C | 90.3 | 0.100 | 30.5% | $5.19 \times 10^9$ |
| D | 81.5 | 0.101 | 35.1% | $6.31 \times 10^9$ |
| E | 82.4 | 0.106 | 39.4% | $9.07 \times 10^9$ |
| F | 103 | 0.124 | 36.8% | $15.09 \times 10^9$ |
| G | 157 | 0.183 | 39.1% | $39.10 \times 10^9$ |
| H | 205 | 0.245 | 40.9% | $66.26 \times 10^9$ |
| I | 63.1 | 0.082 | 36.1% | 0 |

The non-aqueous inks used for recording on the recording papers A to I were prepared in the following formulations by using channel carbon black (C.I. No. 77266, Special Black 4A, produced by Degussa AG) as a pigment.

71.4 parts by weight of IOP (octyl palmitate, produced by Kokyu Alcohol Kogyo Co., Ltd.) as a non-aqueous solvent, 14.3 parts by weight of channel carbon black (C.I. No. 77266, Special Black 4A, produced by Degussa AG) as a pigment, and 14.3 parts by weight of Disperbyk 116 (produced by BYK Chemie Co., Ltd.) as a dispersant were mixed and dispersed in a beads mill. Finally, the dispersion was filtered with a filter of 3 μm to remove pigment aggregates and the like, whereby an ink 1 was obtained.

Various kinds of inks were prepared by changing the kind of the non-aqueous solvent, the concentration of the pigment, and the kind and concentration of the dispersant according to the formulations shown in Table 2 below.

As the solvents, the following three kinds of solvents were prepared in addition to IOP.

ICM-R: isocetyl mylistate (produced by Kokyu Alcohol Kogyo Co., Ltd.)

MW: Moresco White P-40 (produced by Matsumura Oil Research Corp.)

ISA: isostearyl alcohol (produced by Kokyu Alcohol Kogyo Co., Ltd.)

The dispersants used were as follows.

D1: Disperbyk 116

D2: Solsperse 13940

D3: ethylene oxide-propylene oxide block copolymer

TABLE 2

| | | Pigment | Dispersant | |
|---|---|---|---|---|
| Ink | Solvent | concentration (% by weight) | Kind* | Concentration (% by weight) |
| 1 | IOP | 14.3 | D1 | 14.3 |
| 2 | IOP | 12.1 | D1 | 12.1 |
| 3 | IOP | 9.7 | D1 | 9.7 |
| 4 | IOP | 6.9 | D1 | 6.9 |
| 5 | ICM-R | 14.3 | D1 | 14.3 |
| 6 | ICM-R | 12.1 | D1 | 12.1 |
| 7 | ICM-R | 9.7 | D1 | 9.7 |
| 8 | ICM-R | 6.9 | D1 | 6.9 |
| 9 | MW | 15.0 | D2 | 6.0 |
| 10 | MW + ISA | 15.0 | D3 | 6.8 |
| 11 | MW | 20.0 | D2 | 7.6 |
| 12 | MW + ISA | 25.0 | D3 | 11.2 |

The resulting non-aqueous inks for inkjet recording were measured for viscosity at 25° C. by using a viscometer (Viscometer Model TV-33, produced by Toki Sangyo Co., Ltd.) In consideration of facility on feeding an ink to an inkjet head, the viscosity at 25° C. is preferably about 100 mPa·sec or less. The viscosities of the inks are summarized in Table 3 below.

TABLE 3

| Ink | Viscosity (mPa · s) |
|---|---|
| 1 | 43.5 |
| 2 | 34.4 |
| 3 | 25.9 |
| 4 | 20.3 |
| 5 | 73.9 |
| 6 | 58.8 |
| 7 | 45.0 |
| 8 | 35.3 |
| 9 | 13.0 |
| 10 | 43.7 |
| 11 | 67.0 |
| 12 | 203.6 |

The ink No. 12 could not be used in the subsequent printing test due to the high viscosity at 25° C.

Recording was performed on the recording papers A to I under various conditions by using the inks Nos. 1 to 11, and the printing density and the print through density were measured.

The recording was performed by using an image evaluation device equipped with a piezoelectric inkjet head (Model CB1, 318 nozzles, 150 dpi, produced by Toshiba Tec Corp.) The head used herein can control the size of droplets for forming one dot to a volume of from 1 to 7 droplets by the multidrop system. The volume of one droplet is 6 pl as the standard, and the volume of seven droplets is 42 pl as the standard. The size of one droplet can be controlled from 4.5 to 7.5 pl by changing the driving voltage for discharging. According to the operation, the size of the droplets for forming one dot can be controlled to an arbitrary value of from 4.5 to 7.5 pl and 9 to 52.5 pl.

For example, upon discharging the ink 1 at 55° C. (ink viscosity: about 18 mPa·s), the minimum size of one droplet is changed as follows corresponding to the driving voltage. The size is 7.5 pl on 28.0 V, 6.0 pl on 24.3 V, and 4.5 pl on 20.6 V.

As an image for evaluation, a solid image of 2.1 cm×2.7 cm was formed on one surface of the recording paper. Furthermore, images containing characters were printed on both surfaces of the recording paper. In order to perform double face printing, a character pattern was firstly printed on the front surface, and after turning recording paper upside down, the similar character pattern was then printed on the back surface.

In the case where the printing operation is carried out 2 pass (in which the first pass and the second pass are printed with the head being shifted by one pixel of 300 dpi each in the direction perpendicular to the printing direction) at 300 dpi, the ink discharge amount per unit area can be changed by changing the volume of droplets for forming one dot. For example, in the case where the volume of droplets for forming one dot is 6 pl, such an image for evaluation can be obtained that has an ink discharge amount (pl/m$^2$) per unit area of $0.84\times10^9$ pl/m$^2$.

The conditions for obtaining desired ink discharge amounts are shown in Table 4 below.

TABLE 4

| pass | dpi | Volume of droplets (pl) | Ink discharge amount (pl/m$^2$) |
|---|---|---|---|
| 2 | 300 | 6 | $0.84 \times 10^9$ |
| | | 12 | $1.67 \times 10^9$ |
| | | 18 | $2.51 \times 10^9$ |
| | | 24 | $3.35 \times 10^9$ |
| | | 30 | $4.18 \times 10^9$ |
| | | 36 | $5.02 \times 10^9$ |
| | | 42 | $5.86 \times 10^9$ |
| 4 | 600 | 12 | $6.69 \times 10^9$ |
| | | 18 | $10.04 \times 10$ |
| 2 | 300 | 19.2 | $2.68 \times 10^9$ |
| | | 20.2 | $2.82 \times 10^9$ |
| | | 21.2 | $2.96 \times 10^9$ |
| | | 31.5 | $4.39 \times 10^9$ |
| | | 32.5 | $4.53 \times 10^9$ |
| | | 33.5 | $4.67 \times 10^9$ |
| | | 36.2 | $5.05 \times 10^9$ |
| | | 37.2 | $5.19 \times 10^9$ |
| | | 38.2 | $5.32 \times 10^9$ |
| | | 44.3 | $6.17 \times 10^9$ |
| | | 45.3 | $6.31 \times 10^9$ |
| | | 46.3 | $6.45 \times 10^9$ |

As shown in Tables 5 to 9 below, images were formed with combinations of the recording paper, the ink and the ink discharge amount under each condition. The pigment concentrations of the inks are also shown in the following tables.

TABLE 5

| Example | Recording paper | Ink | Pigment concentration (% by weight) | Ink discharge amount (pl/m$^2$) |
|---|---|---|---|---|
| 1 | A | 1 | 14.3 | $2.51 \times 10^9$ |
| 2 | | 2 | 12.1 | |
| 3 | | 3 | 9.7 | |
| 4 | | 4 | 6.9 | |
| 5 | B | 1 | 14.3 | $4.18 \times 10^9$ |
| 6 | | 2 | 12.1 | |
| 7 | | 3 | 9.7 | |
| 8 | | 4 | 6.9 | |
| 9 | C | 1 | 14.3 | $5.02 \times 10^9$ |
| 10 | | 2 | 12.1 | |
| 11 | | 3 | 9.7 | |
| 12 | | 4 | 6.9 | |
| 13 | D | 1 | 14.3 | $5.86 \times 10^9$ |
| 14 | | 2 | 12.1 | |
| 15 | | 3 | 9.7 | |
| 16 | | 4 | 6.9 | |
| 17 | E | 1 | 14.3 | $6.69 \times 10^9$ |
| 18 | | 2 | 12.1 | |
| 19 | | 3 | 9.7 | |
| 20 | | 4 | 6.9 | |

TABLE 6

| Example | Recording paper | Ink | Pigment concentration (% by weight) | Ink discharge amount (pl/m$^2$) |
|---|---|---|---|---|
| 21 | F | 1 | 14.3 | $10.04 \times 10^9$ |
| 22 | | 2 | 12.1 | |
| 23 | | 3 | 9.7 | |
| 24 | | 4 | 6.9 | |
| 25 | G | 1 | 14.3 | $10.04 \times 10^9$ |
| 26 | | 2 | 12.1 | |
| 27 | | 3 | 9.7 | |
| 28 | | 4 | 6.9 | |
| 29 | H | 1 | 14.3 | $10.04 \times 10^9$ |
| 30 | | 2 | 12.1 | |

TABLE 6-continued

| Example | Recording paper | Ink | Pigment concentration (% by weight) | Ink discharge amount ($pl/m^2$) |
|---|---|---|---|---|
| 31 | | 3 | 9.7 | |
| 32 | | 4 | 6.9 | |
| 33 | A | 5 | 14.3 | $2.51 \times 10^9$ |
| 34 | | 6 | 12.1 | |
| 35 | | 7 | 9.7 | |
| 36 | | 8 | 6.9 | |
| 37 | B | 5 | 14.3 | $4.18 \times 10^9$ |
| 38 | | 6 | 12.1 | |
| 39 | | 7 | 9.7 | |
| 40 | | 8 | 6.9 | |

TABLE 7

| Example | Recording paper | Ink | Pigment concentration (% by weight) | Ink discharge amount ($pl/m^2$) |
|---|---|---|---|---|
| 41 | C | 5 | 14.3 | $5.02 \times 10^9$ |
| 42 | | 6 | 12.1 | |
| 43 | | 7 | 9.7 | |
| 44 | | 8 | 6.9 | |
| 45 | D | 5 | 14.3 | $5.86 \times 10^9$ |
| 46 | | 6 | 12.1 | |
| 47 | | 7 | 9.7 | |
| 48 | | 8 | 6.9 | |
| 49 | E | 5 | 14.3 | $6.69 \times 10^9$ |
| 50 | | 6 | 12.1 | |
| 51 | | 7 | 9.7 | |
| 52 | | 8 | 6.9 | |
| 53 | F | 5 | 14.3 | $10.04 \times 10^9$ |
| 54 | | 6 | 12.1 | |
| 55 | | 7 | 9.7 | |
| 56 | | 8 | 6.9 | |
| 57 | G | 5 | 14.3 | $10.04 \times 10^9$ |
| 58 | | 6 | 12.1 | |
| 59 | | 7 | 9.7 | |
| 60 | | 8 | 6.9 | |

TABLE 8

| Example | Recording paper | Ink | Pigment concentration (% by weight) | Ink discharge amount ($pl/m^2$) |
|---|---|---|---|---|
| 61 | H | 5 | 14.3 | $10.04 \times 10^9$ |
| 62 | | 6 | 12.1 | |
| 63 | | 7 | 9.7 | |
| 64 | | 8 | 6.9 | |
| 65 | A | 9 | 15.0 | $2.51 \times 10^9$ |
| 66 | B | | | $4.18 \times 10^9$ |
| 67 | C | | | $5.02 \times 10^9$ |
| 68 | D | | | $5.86 \times 10^9$ |
| 69 | E | | | $6.69 \times 10^9$ |
| 70 | F | | | $10.04 \times 10^9$ |
| 71 | G | | | $10.04 \times 10^9$ |
| 72 | H | | | $10.04 \times 10^9$ |
| 73 | A | 10 | 15.0 | $2.15 \times 10^9$ |
| 74 | B | | | $4.18 \times 10^9$ |
| 75 | C | | | $5.02 \times 10^9$ |
| 76 | D | | | $5.86 \times 10^9$ |
| 77 | E | | | $6.69 \times 10^9$ |
| 78 | F | | | $10.04 \times 10^9$ |
| 79 | G | | | $10.04 \times 10^9$ |
| 80 | H | | | $10.04 \times 10^9$ |

TABLE 9

| Example | Recording paper | Ink | Pigment concentration (% by weight) | Ink discharge amount ($pl/m^2$) |
|---|---|---|---|---|
| 81 | A | 11 | 20.0 | $2.51 \times 10^9$ |
| 82 | B | | | $4.18 \times 10^9$ |
| 83 | C | | | $5.02 \times 10^9$ |
| 84 | D | | | $5.86 \times 10^9$ |
| 85 | E | 11 | 20.0 | $6.69 \times 10^9$ |
| 86 | F | | | $10.04 \times 10^9$ |
| 87 | G | | | $10.04 \times 10^9$ |
| 88 | H | | | $10.04 \times 10^9$ |
| 89 | A | 1 | 14.3 | $2.68 \times 10^9$ |
| 90 | | | | $2.82 \times 10^9$ |
| 91 | B | 5 | 14.3 | $4.39 \times 10^9$ |
| 92 | | | | $4.53 \times 10^9$ |
| 93 | C | 2 | 12.1 | $5.05 \times 10^9$ |
| 94 | | | | $5.19 \times 10^9$ |
| 95 | D | 6 | 12.1 | $6.17 \times 10^9$ |
| 96 | | | | $6.31 \times 10^9$ |
| 97 | A | 1 | 14.3 | $1.67 \times 10^9$ |
| 98 | B | 2 | 12.1 | |
| 99 | C | 3 | 9.7 | |
| 100 | E | 4 | 6.9 | |

In Examples 1 to 100, recording paper having a thickness exceeding 0.083 mm was used, and furthermore, the ink discharge amount per unit area was equal to or less than the allowable ink amount per unit area of the recording paper.

For comparison, as shown in Table 10 below, images were formed with combinations of the recording paper, the ink and the ink discharge amount. In the comparative examples, the ink was discharged in an amount exceeding the allowable ink amount per unit area of the recording paper. In Comparative Examples 11 to 16, particularly, the thickness of the recording paper used was 0.083 mm or less.

TABLE 10

| Comparative Example | Recording paper | Ink | Pigment concentration (% by weight) | Ink discharge amount ($pl/m^2$) |
|---|---|---|---|---|
| 1 | A | 1 | 14.3 | $3.35 \times 10^9$ |
| 2 | D | 2 | 12.1 | $6.69 \times 10^9$ |
| 3 | C | 3 | 9.7 | $5.86 \times 10^9$ |
| 4 | E | 4 | 6.9 | $10.04 \times 10^9$ |
| 5 | B | 5 | 14.3 | $5.02 \times 10^9$ |
| 6 | A | 9 | 15.0 | $3.35 \times 10^9$ |
| 7 | D | | | $6.69 \times 10^9$ |
| 8 | C | | | $5.86 \times 10^9$ |
| 9 | E | 10 | 15.0 | $10.04 \times 10^9$ |
| 10 | B | | | $5.02 \times 10^9$ |
| 11 | I | 5 | 14.3 | $0.84 \times 10^9$ |
| 12 | | 6 | 12.1 | |
| 13 | | 7 | 9.7 | |
| 14 | | 8 | 6.9 | |
| 15 | | 9 | 15.0 | |
| 16 | | 10 | 15.0 | |
| 17 | A | 1 | 14.3 | $2.96 \times 10^9$ |
| 18 | B | 5 | 14.3 | $4.67 \times 10^9$ |
| 19 | C | 2 | 12.1 | $5.32 \times 10^9$ |
| 20 | D | 6 | 12.1 | $6.45 \times 10^9$ |

The resulting images were measured for density by using a Macbeth densitometer (Macbeth reflection densitometer, Model RD918) to obtain Macbeth densities.

An average value of the Macbeth densities was calculated for the six solid images for evaluation to obtain a printing density. The printing density was evaluated in the following standards.

A: Average value of Macbeth density of 1.00 or more

B: Average value of Macbeth density of 0.90 or more and less than 1.00

C: Average value of Macbeth density of less than 0.90

In the case where the evaluation is B or better, it can be understood that a printed matter having high quality with high density on the front surface is obtained.

The print through density was obtained in the following manner. The print through density ($M_1$-$M_0$) was obtained with the Macbeth density on the back surface of the solid image for evaluation $M_1$ and the Macbeth density of the recording paper $M_0$. An average value of the print through densities of six sheets was obtained and evaluated in the following standard.

B: Average value of print through density of less than 0.15

C: Average value of print through density of 0.15

D: Average value of print through density exceeding 0.15

Upon observing visually the double face printed matter, it was confirmed that a sample evaluated as B had good quality without print through, and a sample evaluated as C had no practical problem although print through was observed. A sample evaluated as D was hard to use due to print through.

The images of Examples and Comparative Examples were measured for printing density and print through density. The results obtained are summarized in Tables 11 to 15 below.

TABLE 11

| Example | Printing density | Print through density |
|---|---|---|
| 1 | B | B |
| 2 | B | B |
| 3 | B | B |
| 4 | B | B |
| 5 | A | B |
| 6 | A | B |
| 7 | B | B |
| 8 | B | B |
| 9 | A | B |
| 10 | A | B |
| 11 | A | B |
| 12 | A | B |
| 13 | A | B |
| 14 | A | B |
| 15 | A | B |
| 16 | A | B |
| 17 | A | B |
| 18 | A | B |
| 19 | A | B |
| 20 | A | B |
| 21 | A | B |
| 22 | A | B |
| 23 | A | B |
| 24 | A | B |
| 25 | A | B |

TABLE 12

| Example | Printing density | Print through density |
|---|---|---|
| 26 | A | B |
| 27 | A | B |
| 28 | A | B |
| 29 | A | B |
| 30 | A | B |
| 31 | A | B |
| 32 | A | B |
| 33 | B | B |
| 34 | B | B |
| 35 | B | B |
| 36 | B | B |
| 37 | A | B |

TABLE 12-continued

| Example | Printing density | Print through density |
|---|---|---|
| 38 | A | B |
| 39 | B | B |
| 40 | B | B |
| 41 | A | B |
| 42 | A | B |
| 43 | A | B |
| 44 | A | B |
| 45 | A | B |
| 46 | A | B |
| 47 | A | B |
| 48 | A | B |
| 49 | A | B |
| 50 | A | B |

TABLE 13

| Example | Printing density | Print through density |
|---|---|---|
| 51 | A | B |
| 52 | A | B |
| 53 | A | B |
| 54 | A | B |
| 55 | A | B |
| 56 | A | B |
| 57 | A | B |
| 58 | A | B |
| 59 | A | B |
| 60 | A | B |
| 61 | A | B |
| 62 | A | B |
| 63 | A | B |
| 64 | A | B |
| 65 | B | B |
| 66 | A | B |
| 67 | A | B |
| 68 | A | B |
| 69 | A | B |
| 70 | A | B |
| 71 | A | B |
| 72 | A | B |
| 73 | B | B |
| 74 | A | B |
| 75 | A | B |

TABLE 14

| Example | Printing density | Print through density |
|---|---|---|
| 76 | A | B |
| 77 | A | B |
| 78 | A | B |
| 79 | A | B |
| 80 | A | B |
| 81 | B | B |
| 82 | A | B |
| 83 | A | B |
| 84 | A | B |
| 85 | A | B |
| 86 | A | B |
| 87 | A | B |
| 88 | A | B |
| 89 | B | B |
| 90 | B | C |
| 91 | A | B |
| 92 | A | C |
| 93 | A | B |
| 94 | A | C |
| 95 | A | B |
| 96 | A | C |
| 97 | C | B |
| 98 | C | B |

TABLE 14-continued

| Example | Printing density | Print through density |
|---|---|---|
| 99 | C | B |
| 100 | C | B |

TABLE 15

| Example | Printing density | Print through density |
|---|---|---|
| 1 | A | D |
| 2 | A | D |
| 3 | A | D |
| 4 | A | D |
| 5 | A | D |
| 6 | A | D |
| 7 | A | D |
| 8 | A | D |
| 9 | A | D |
| 10 | A | D |
| 11 | C | D |
| 12 | C | D |
| 13 | C | D |
| 14 | C | D |
| 15 | C | D |
| 16 | C | D |
| 17 | A | D |
| 18 | A | D |
| 19 | A | D |
| 20 | A | D |

As shown in the tables, in Comparative Examples 1 to 20, double face printing is difficult due to the high print through density since the ink discharge amount per unit area exceeds the allowable ink amount per unit area.

In particular, the paper I used for recording in Comparative Examples 11 to 16 has an allowable ink amount of 0 pl/m$^2$ as shown in Table 2. Accordingly, it exhibits a large print through density and further a small printing density. Therefore, a printed matter having high quality with a high front surface density cannot be obtained.

In Examples, on the other hand, the ink is discharged at an amount equal to or less than the allowable ink amount per unit area of the recording paper, whereby a double face printed manner having high quality without print through can be obtained. Example 97 is carried out in the same conditions as in Example 1 except that the ink discharge amount is decreased from $2.51\times10^9$ (pl/m$^2$) to $1.67\times10^9$ (pl/m$^2$). It is understood from the comparison between Example 1 and Example 97 that a considerable high printing density can be obtained when the ink is discharged at a volume of $2.51\times10^9$ (pl/m$^2$) or more. This can also be understood from the comparison between Example 6 and Example 98, the comparison between Example 11 and Example 99, and the comparison between Example 20 and Example 100.

It is understood, for example, from the results of Examples 65 to 72 that a printed matter having high quality with a higher front surface density can be obtained when recording paper having a thickness of 0.095 mm or more is used. The same tendency is also shown by the results of Examples 73 to 80 and the results of Examples 81 to 88.

In particular, it is understood, for example, from the results of Example 65 to 72 that a printed matter having higher quality with a further higher front surface density can be obtained when the thickness of the recording paper is 0.100 mm or more. This is also understood from the comparison between Example 8 and Example 12, the comparison between Example 39 and Example 43, and the comparison between Example 40 and Example 44.

As having been described, in the recording method according to the embodiment of the invention, double face printing can be performed under optimum conditions by comparing the allowable ink amount of the recording paper and the ink discharge amount. Since the ink discharge amount is the maximum ink discharge amount in the image data, the allowable ink amount of the recording paper and the maximum ink discharge amount of the image data to be recorded thereon are compared to each other, and double face printing is performed when the maximum ink discharge amount is equal to or less than the allowable ink amount. According to the operation, a favorable image having a high printing density without print through can be obtained.

In order to obtain favorable double face printing by the method according to the embodiment of the invention in an inkjet recording apparatus, the operation may be performed, for example, by the following flow chart. Specifically, image data is received and compared to the allowable ink amount of the recording paper, and it is determined in advance as to whether or not there is such a condition that favorable double face printing can be obtained. In the case where favorable double face printing cannot be obtained by the condition, the printing operation is performed, for example, by switching to single face printing. In alternative, the image data is converted, or the head driving condition is adjusted, so as to provide a condition capable of providing favorable double face printing.

The flow charts of various kinds of process will be described with reference to the block diagrams shown in FIGS. 1 to 4. In each case, the allowable ink amount of the recording paper housed in a paper delivery tray of a recording apparatus is calculated in the aforementioned manner and stored in a memory part in advance.

The block diagram in FIG. 1 shows an example of the case where double face printing is switched to single face printing.

Upon receiving an instruction of a printing operation, it is determined as to whether the printing operation is double face printing or single face printing. In the case of single face printing, the image data is received as it is, and single face printing is performed. In the case of double face printing, the data of the allowable ink amount of the recording paper to be recorded is read out from the memory part.

The allowable ink amount of the recording paper is compared to the maximum ink discharge amount. It is determined as to whether double face printing is capable or incapable based on the set standard, for example, from the following items (1) to (5). The standard capable of being set is not limited to the items (1) to (5). In the case where the set standard is not satisfied, it is determined that double face printing is capable, and thus double face printing is performed. In the case where the set standard is satisfied, it is incapable.

(1) The case where the image data contains a part where the maximum ink discharge amount exceeds the allowable ink amount of the recording paper (2) The case where upon superimposing image data of both surfaces, parts where the maximum ink discharge amount exceeds the allowable ink amount of the recording paper overlap each other (3) The case where upon superimposing image data of both surfaces, a part where the maximum ink discharge amount exceeds the allowable ink amount of the recording paper is present on one surface, and an image is present on the back surface at the part (4) The case where upon superimposing image data of both surfaces, parts where the maximum ink discharge amount exceeds the allowable ink amount of the recording paper overlap each other, and the proportion of the overlapping part exceeds 6% of the total area of the paper (5) The case where upon superimposing image data of both surfaces, a part where the maximum ink discharge amount exceeds the allowable ink amount of the recording paper is present on one surface, an image is present on the back surface at the part, and the proportion of the part exceeds 6% of the total area of the paper In the case where the set standard is satisfied to determine that double face printing is incapable, the printing operation is performed by switching to single face printing. The process can be carried out automatically. In alternative, the operation is returned to the issuance of the printing instruction, and an operator is inquired as to whether or not single face printing may be performed.

Figure 2:
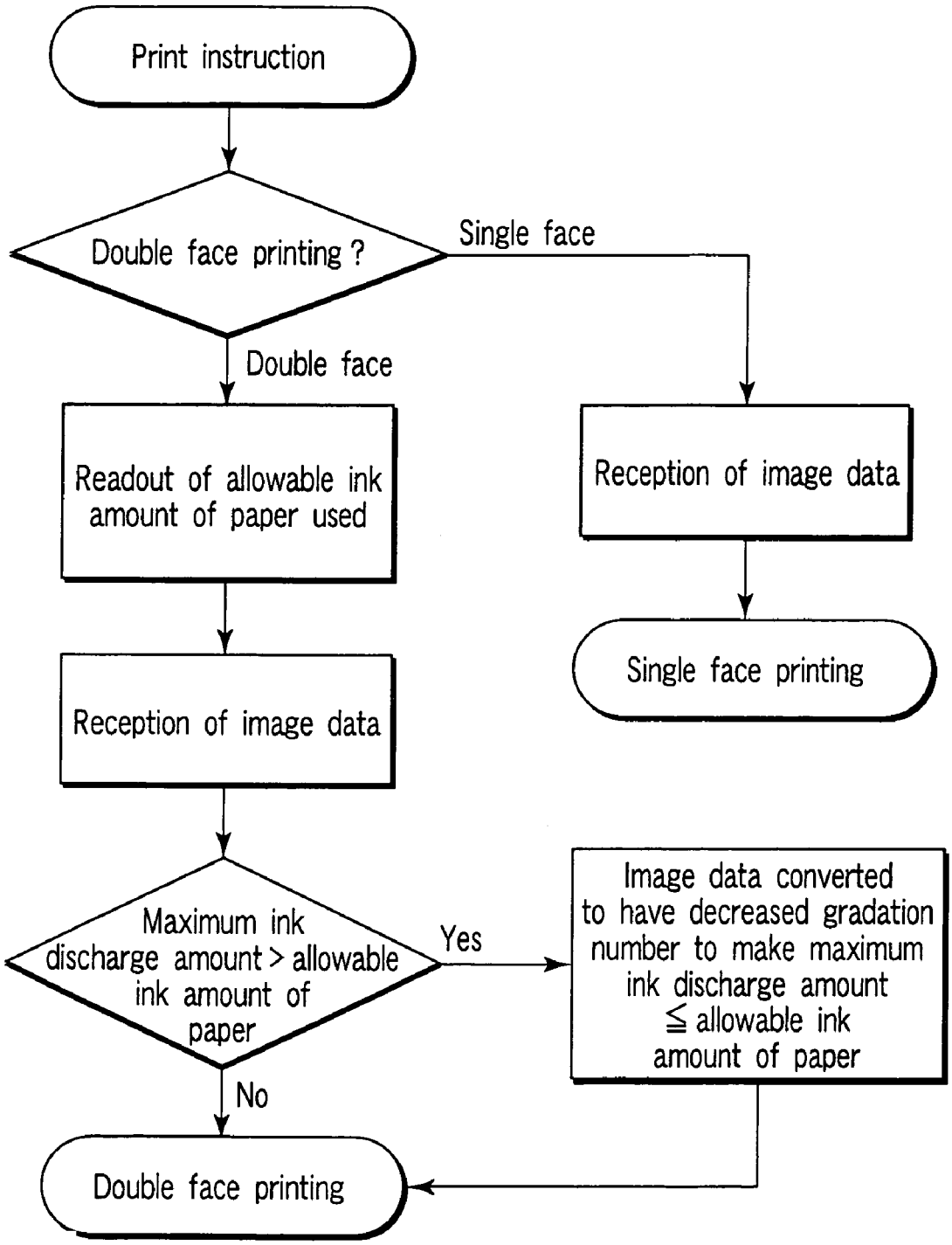
FIG. 2 is a block diagram showing process steps of a recording method according to another embodiment of the invention.

The block diagram of FIG. 2 shows an example of the case where double face printing is performed by decreasing the gradation number of the image data.

Upon receiving an instruction of a printing operation, it is determined as to whether the printing operation is double face printing or single face printing. In the case of single face printing, the image data is received as it is, and single face printing is performed. In the case of double face printing, the data of the allowable ink amount of the recording paper to be recorded is read out from the memory part.

The allowable ink amount of the recording paper is compared to the maximum ink discharge amount to conduct the same determination as above. In the case where the set standard is not satisfied, it is determined that double face printing is capable, and double face printing is performed. In the case where the set standard is satisfied, it is incapable, and double face printing is performed with image data decreased in gradation number produced. The process can be carried out automatically. In alternative, the operation is returned to the issuance of the printing instruction, and an operator is inquired as to whether or not printing with image data decreased in gradation number may be performed.

One example of a method for decreasing the gradation number of image data will be described. For example, in the case where data with 255 gradations is converted to 8 gradations, the conversion is generally carried out in the following manner. The levels of from 0 to 18 are converted to 0, the levels of from 19 to 54 are converted to 1, the levels of from 55 to 90 are converted to 2, the levels of 91 to 126 are converted to 3, the levels of from 127 to 162 are converted to 4, the levels of from 163 to 198 are converted to 5, the levels of from 199 to 234 are converted to 6, and the levels of from 235 to 255 are converted to 7.

In the case where the gradation number is decreased from 8 to 6, the levels of from 0 to 26 are converted to 0, the levels of from 27 to 77 are converted to 1, the levels of from 78 to 128 are converted to 2, the levels of from 129 to 179 are converted to 3, the levels of from 180 to 230 are converted to 4, and the levels of from 231 to 255 are converted to 5.

In addition to the method of decreasing the gradation number of the image data, favorable double face printing can be performed by reducing the size of droplets for forming a dot.

Figure 3:
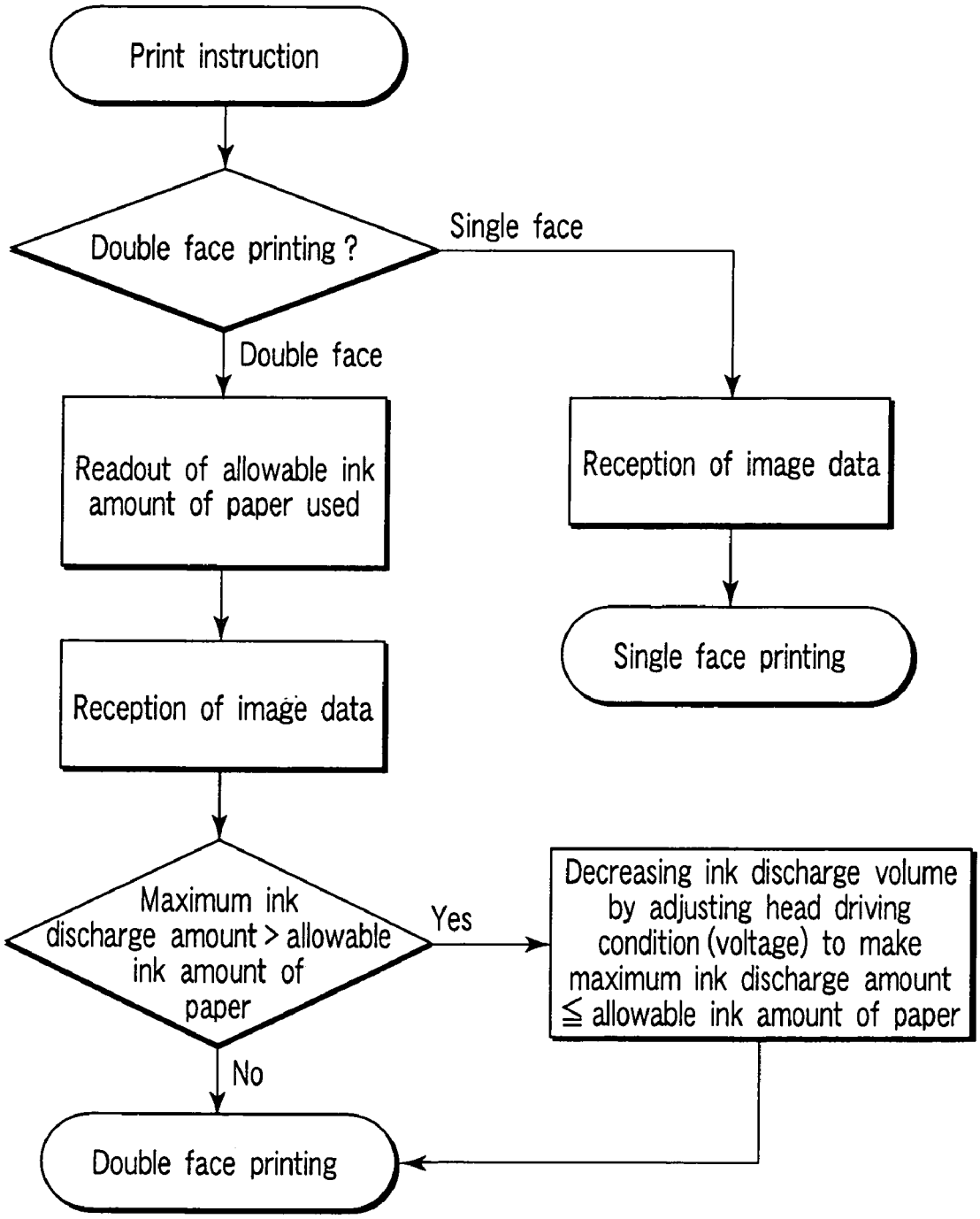
FIG. 3 is a block diagram showing process steps of a recording method according to still another embodiment of the invention.

The block diagram of FIG. 3 shows an example of the case where double face printing is performed by reducing the size of droplets for forming a dot.

Upon receiving an instruction of a printing operation, it is determined as to whether the printing operation is double face printing or single face printing. In the case of single face printing, the image data is received as it is, and single face printing is performed. In the case of double face printing, the data of the allowable ink amount of the recording paper to be recorded is read out from the memory part.

The allowable ink amount of the recording paper is compared to the maximum ink discharge amount to conduct the same determination as above. In the case where the set standard is not satisfied, it is determined that double face printing is capable, and double face printing is performed. In the case where the set standard is satisfied, it is incapable, and double face printing is performed by decreasing the driving voltage of the head to provide such a condition that the maximum ink discharge amount is equal to or less than the allowable ink amount.

For example, in the case where expression is made with 8 gradations, it is necessary that the allowable ink amount of the recording paper used exceeds $4.39\times10^9$ pl/m$^2$. In the case where the size of ink droplets is controlled by decreasing the voltage, the droplet size of 7 droplets is from 31.5 to 52.5 pl. The ink discharge amount per unit area is $4.39\times10^9$ pl/m$^2$ for a droplet size of 31.5 pl, and therefore, the allowable ink amount of the recording paper is necessarily larger than that value.

The reduction in droplet size may be carried out along with decrease in gradation number of the image data described above.

In some cases, favorable double face printing can be performed by selecting suitable recording paper. In this case, recording paper for double face printing and recording paper for single face printing are prepared in advance inside the inkjet recording apparatus. The recording paper for double face printing referred herein is such recording paper that the maximum ink discharge amount capable of being discharged from the inkjet recording apparatus used is equal to or less than the allowable ink amount.

Figure 4:
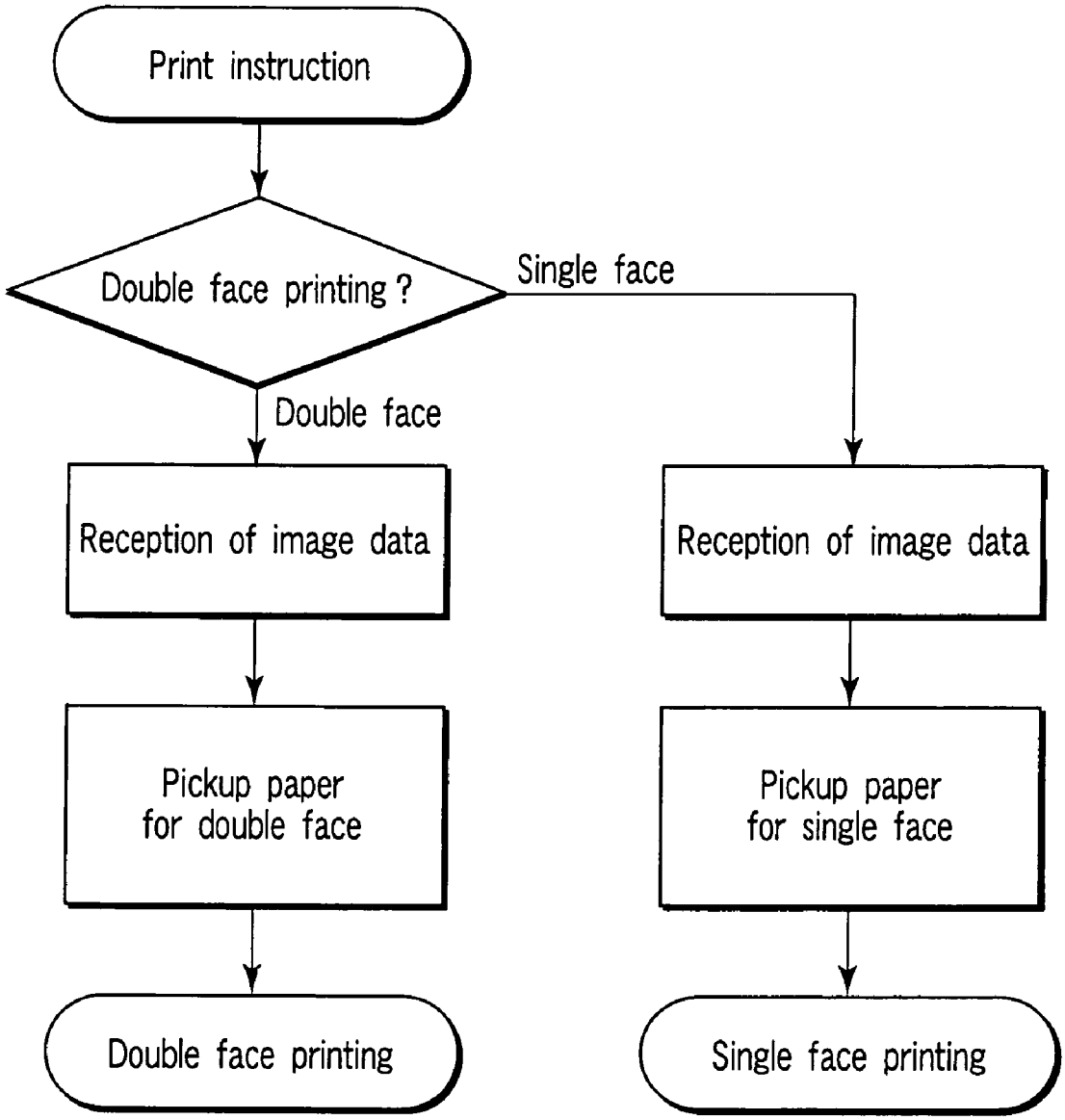
FIG. 4 is a block diagram showing process steps of a recording method according to a further embodiment of the invention.

The block diagram of FIG. 4 shows an example of the case where recording paper for double face printing and recording paper for single face printing are prepared in advance.

Upon receiving an instruction of a printing operation, it is determined as to whether the printing operation is double face printing or single face printing. In the case of single face printing, the image data is received, and single face printing is performed by using the recording paper for single face printing. In the case of double face printing, the image data is received, and double face printing is performed by using the recording paper for double face printing.

In the case where the printing operation is performed with any of the flow charts, the ink is discharged in an amount equal to or less than the allowable ink amount per unit area, and therefore, recording suitable for double face printing can be performed with a low print through density.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for inkjet recording by discharging a non-aqueous ink containing a non-aqueous solvent and a pigment by an inkjet system to record on a recording medium, the method comprising:

a step of preparing recording paper having a thickness exceeding 0.083 mm as a recording medium, a step of obtaining a volume $V_m$ and a thickness $T_m$ of the recording paper, a step of obtaining a volume $V_s$ of a solvent that is capable of being retained by the recording paper by using a solvent having a vapor pressure at 25° C. of 0.001 mmHg or less and a specific gravity of from 0.800 to 1.200, a step of obtaining a solvent absorptivity $A_{sl.}$ (%) of the recording paper by the following equation (1):

$$A_{sl.}=(V_s/V_m)\times 100 \quad (1)$$

a step of obtaining an allowable ink amount $V_I$ (pl/m$^2$) per unit area of the recording paper by the following equation (2):

$$V_I=(T_m-0.083)\times A_{sl.}\times 10^{12} \quad (2)$$

and a step of discharging the non-aqueous ink in an amount $V_d$ (pl/m$^2$) satisfying the following equation (3) by an inkjet system:

$$V_d \leqq V_I \quad (3).$$

2. The method for inkjet recording as claimed in claim 1, wherein the non-aqueous ink is discharged to the recording paper in an amount of $2.51\times 10^9$ (pl/m$^2$) or more.

3. The method for inkjet recording as claimed in claim 1, wherein the thickness $T_m$ of the recording paper is 0.095 mm or more.

4. The method for inkjet recording as claimed in claim 1, wherein the thickness $T_m$ of the recording paper is 0.100 mm or more.

5. A method for selecting recording paper, on which double face printing is performed by discharging a non-aqueous ink in an amount $V_d$ (pl/m$^2$), the method comprising:

a step of preparing recording paper having a thickness exceeding 0.083 mm, a step of obtaining a volume $V_m$ and a thickness $T_m$ of the recording paper, a step of obtaining a volume $V_s$ of a solvent that is capable of being retained by the recording paper by using a solvent having a vapor pressure at 25° C. of 0.001 mmHg or less and a specific gravity of from 0.800 to 1.200, a step of obtaining a solvent absorptivity $A_{sl.}$ (%) of the recording paper by the following equation (1):

$$A_{sl.}=(V_s/V_m)\times 100 \quad (1)$$

a step of obtaining an allowable ink amount $V_I$ (pl/m$^2$) per unit area of the recording paper by the following equation (2):

$$V_I=(T_m-0.083)\times A_{sl.}\times 10^{12} \quad (2)$$

and a step of selecting the recording paper that satisfies a condition of the following equation (3):

$$V_d \leqq V_I \quad (3).$$

6. The method for selecting recording paper as claimed in claim 5, wherein the amount $V_d$ (pl/m$^2$) of the non-aqueous ink is $2.51\times 10^9$ (pl/m$^2$) or more.

7. The method for selecting recording paper as claimed in claim 5, wherein the thickness $T_m$ of the recording paper is 0.095 mm or more.

8. The method for selecting recording paper as claimed in claim 5, wherein the thickness $T_m$ of the recording paper is 0.100 mm or more.

9. A method for evaluating an ink discharge amount for performing double face printing by discharging a non-aqueous ink to recording paper, the method comprising:

a step of preparing recording paper having a thickness exceeding 0.083 mm, a step of obtaining a volume $V_m$ and a thickness $T_m$ of the recording paper, a step of obtaining a volume $V_s$ of a solvent that is capable of being retained by the recording paper by using a solvent having a vapor pressure at 25° C. of 0.001 mmHg or less and a specific gravity of from 0.800 to 1.200, a step of obtaining a solvent absorptivity $A_{sl.}$ (%) of the recording paper by the following equation (1):

$$A_{sl.}=(V_s/V_m)\times 100 \quad (1)$$

a step of obtaining an allowable ink amount $V_I$ (pl/m$^2$) per unit area of the recording paper by the following equation (2):

$$V_I=(T_m-0.083)\times A_{sl.}\times 10^{12} \quad (2)$$

and a step of selecting an amount $V_d$ (pl/m$^2$) satisfying the following equation (3) as an ink amount discharged to the recording paper:

$$V_d \leqq V_I \quad (3).$$

10. The method for evaluating an ink discharge amount as claimed in claim 9, wherein the amount $V_d$ (pl/m$^2$) of the non-aqueous ink is $2.51\times 10^9$ (pl/m$^2$) or more.

11. The method for evaluating an ink discharge amount as claimed in claim 9, wherein the thickness $T_m$ of the recording paper is 0.095 mm or more.

12. The method for evaluating an ink discharge amount as claimed in claim 9, wherein the thickness $T_m$ of the recording paper is 0.100 mm or more.

* * * * *